US007642967B2

(12) United States Patent
Wang et al.

(10) Patent No.: US 7,642,967 B2
(45) Date of Patent: Jan. 5, 2010

(54) MULTI-BAND ANTENNA

(75) Inventors: Shu-Yean Wang, Tu-Cheng (TW); Chen-Ta Hung, Tu-Cheng (TW); Lung-Sheng Tai, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 281 days.

(21) Appl. No.: 11/645,481

(22) Filed: Dec. 26, 2006

(65) Prior Publication Data

US 2007/0146216 A1 Jun. 28, 2007

(30) Foreign Application Priority Data

Dec. 26, 2005 (TW) ..... 94222625 U

(51) Int. Cl.
*H01Q 1/24* (2006.01)

(52) U.S. Cl. ..... 343/702; 343/700 MS; 343/846

(58) Field of Classification Search ..... 343/700 MS, 343/702, 815, 829, 846
See application file for complete search history.

*Primary Examiner*—Douglas W Owens
*Assistant Examiner*—Chuc D Tran
(74) *Attorney, Agent, or Firm*—Wei Te Chung; Andrew C. Cheng; Ming Chieh Chang

(57) ABSTRACT

A multi-band antenna (1) includes a first antenna (2), a second antenna (3) and a common grounding element (4). Both of the first antenna and the second antenna include a radiating element (2', 3'), a connecting element (100, 300) respectively connecting the radiating element (2', 3') and a grounding portion (200, 400).

20 Claims, 5 Drawing Sheets

MULTI-BAND ANTENNA

BACKGROUND OF THE INVENTION

1. Field of the Invention

The present invention relates generally to a multi-band antenna, and more particularly to a multi-band antenna used for electronic devices, such as notebook.

2. Description of the Prior Art

As communication technology is increasingly improved, the weight, volume, cost, performance, and complexity of a communication system also become more important, so antennas that transmit and receive signals in a wireless communication system especially 'draw designers' attention. In a wireless local area network (WLAN), because the space for setting up an antenna is limited and the antenna should transmit a large amount of data, the antenna should be carefully designed. And for the requirement of small size, the antenna is needed to be able to transmit all signals of WLAN bands, 802.11b(2.4 GHz) and 802.11a(5.2 GHz).

Referring now to FIG. 1, a conventional multi-band antenna 1' is shown and includes a first antenna 100' and a second antenna 200' having similar structure as that of the first antenna 100'. Both of the first antenna 100' and the second antenna 200' are used as WLAN antennas. The second antenna 200' has an L-shape low-frequency radiating portion with a band portion 4' located on the free end thereof, so that the low-frequency radiating portion of the first antenna 100' and the low-frequency radiating portion of the second antenna 200' respectively locate in different planes. This structure reduces the interference between the first antenna 100' and the second antenna 200'. However, with the volume of the antenna reducing, the disturb therebetween will become greater, and this structure can not make the antenna 1' achieve enough bandwidth.

Hence, an improved antenna is desired to overcome the above-mentioned shortcomings of the existing antennas.

BRIEF SUMMARY OF THE INVENTION

A primary object, therefore, of the present invention is to provide a multi-band antenna with simple structure, reduced size and lower interference.

In order to implement the above object and overcomes the above-identified deficiencies in the prior art, the multi-band antenna comprises a first antenna, a second antenna, and a common grounding element, wherein both of said first antenna and said second antenna comprises a radiating element having a low-frequency radiating section and a high-frequency radiating section, and the radiating element of said first antenna has a main body locating in a plane different from that of a main body of the radiating element of said second antenna, and said low-frequency radiating section of said first antenna is located adjacent to said high-frequency radiating section of said second antenna.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
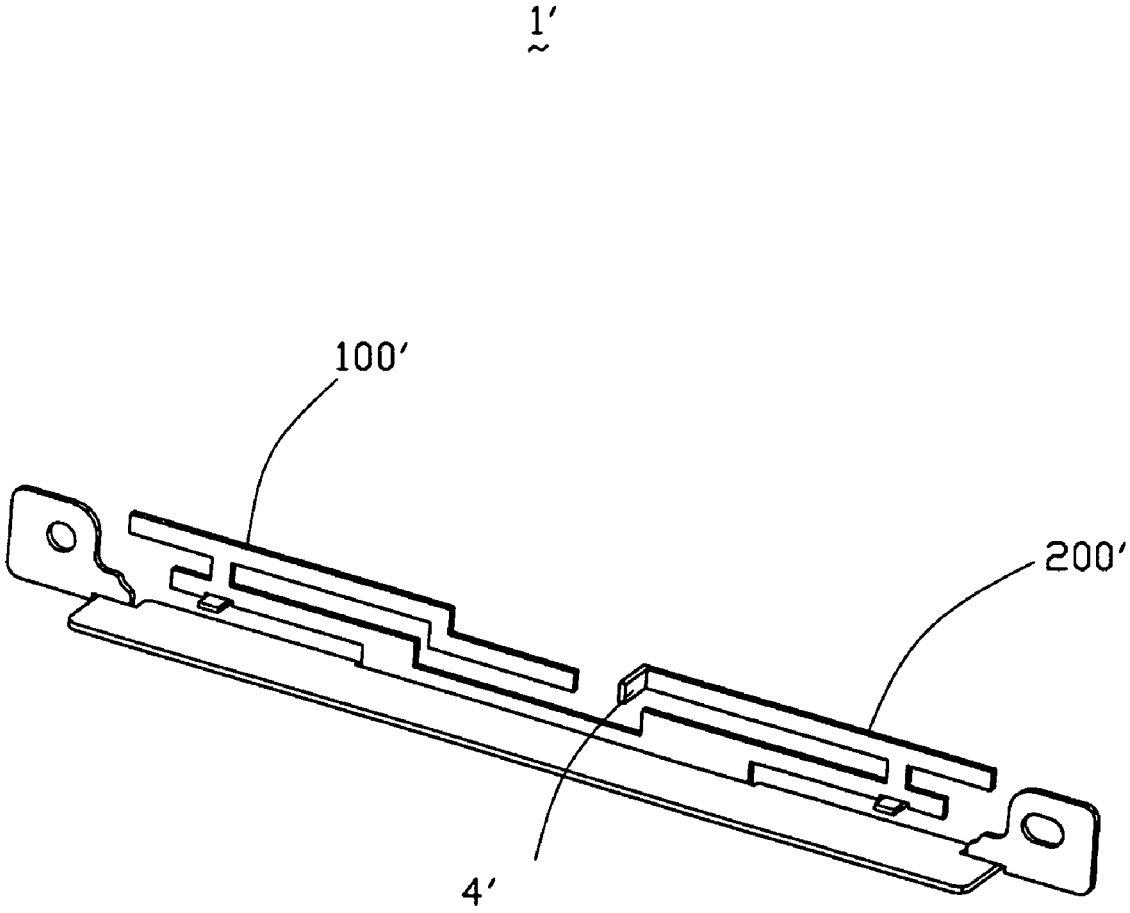
FIG. 1 (PRIOR ART)
FIG. 1 is a perspective view illustrating a conventional multi-band antenna.
Figure 2:
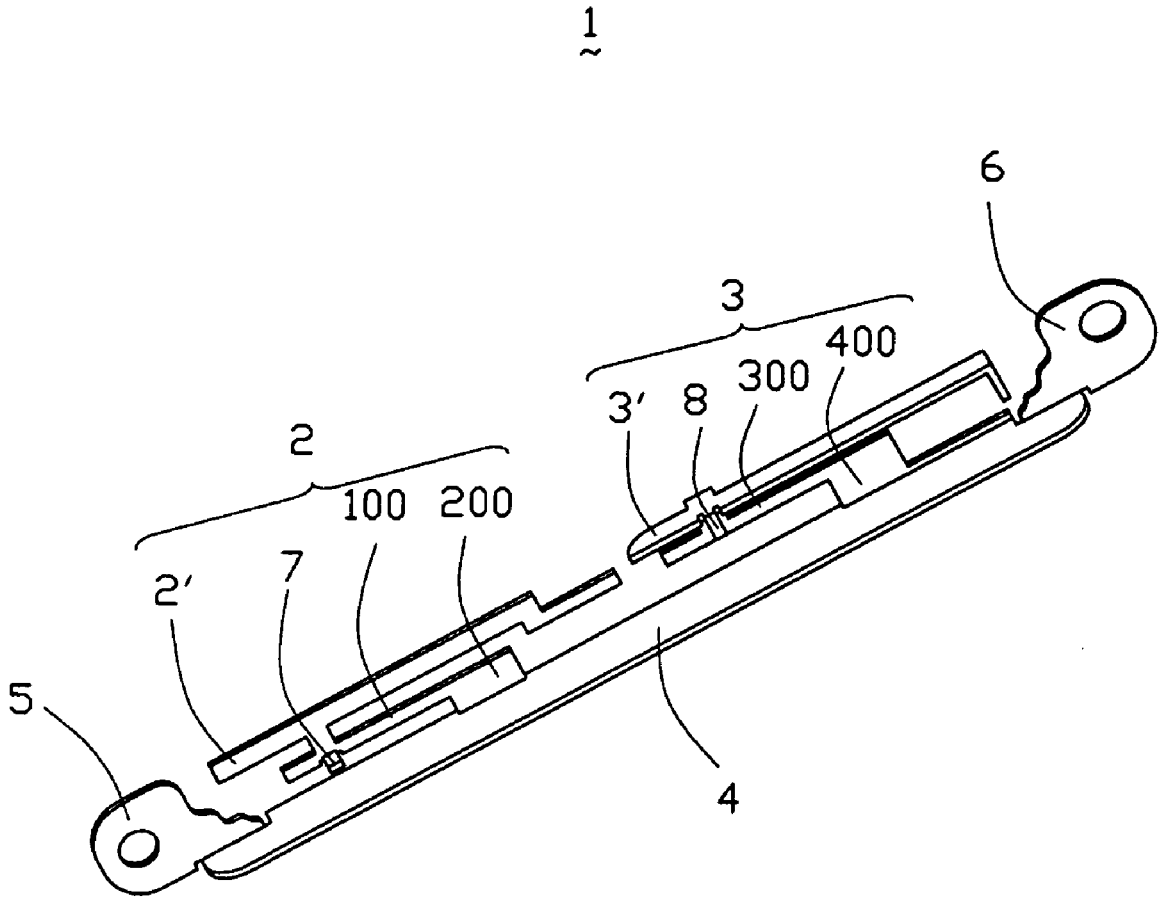
FIG. 2 is a perspective view of a multi-band antenna according to a preferred embodiment of the present invention.
Figure 3:
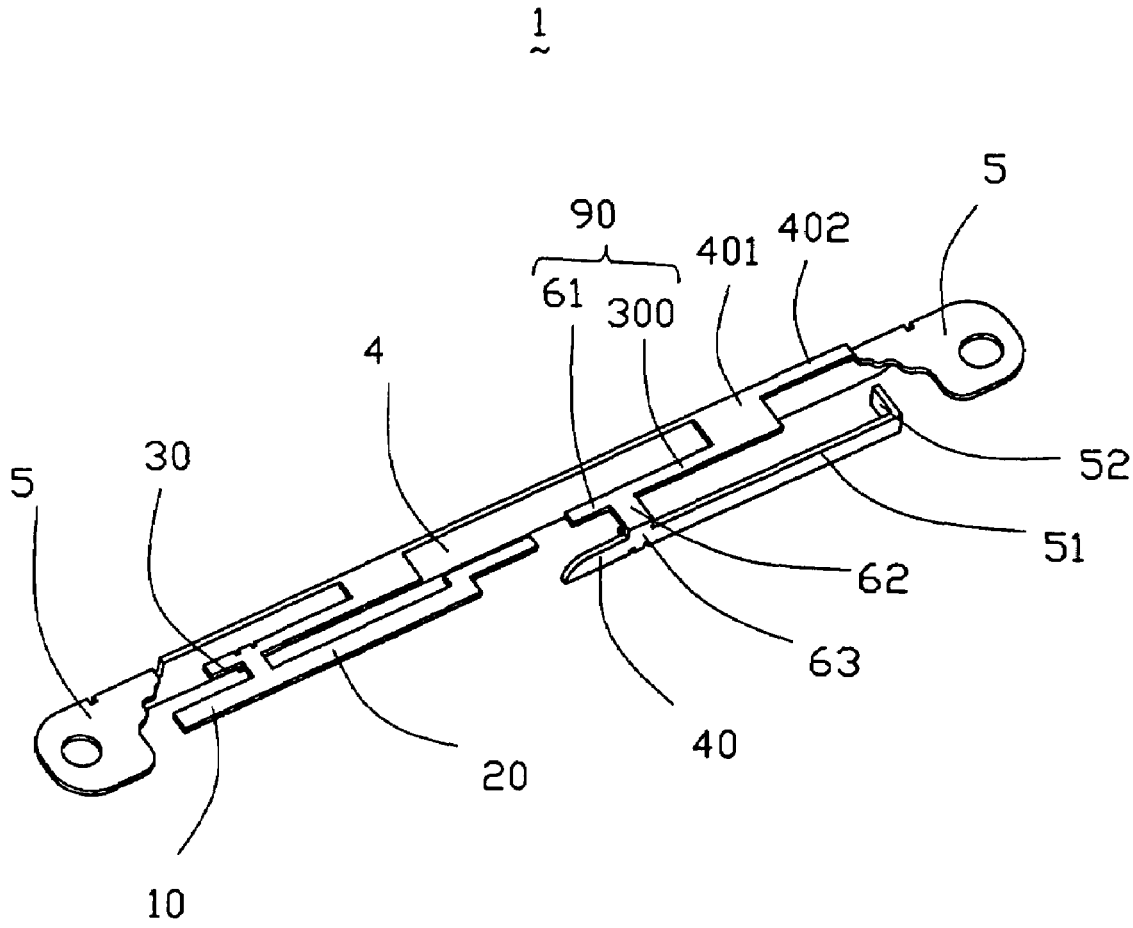
FIG. 3-5 are views similar to FIG. 2 but take from different aspects.
Figure 4:
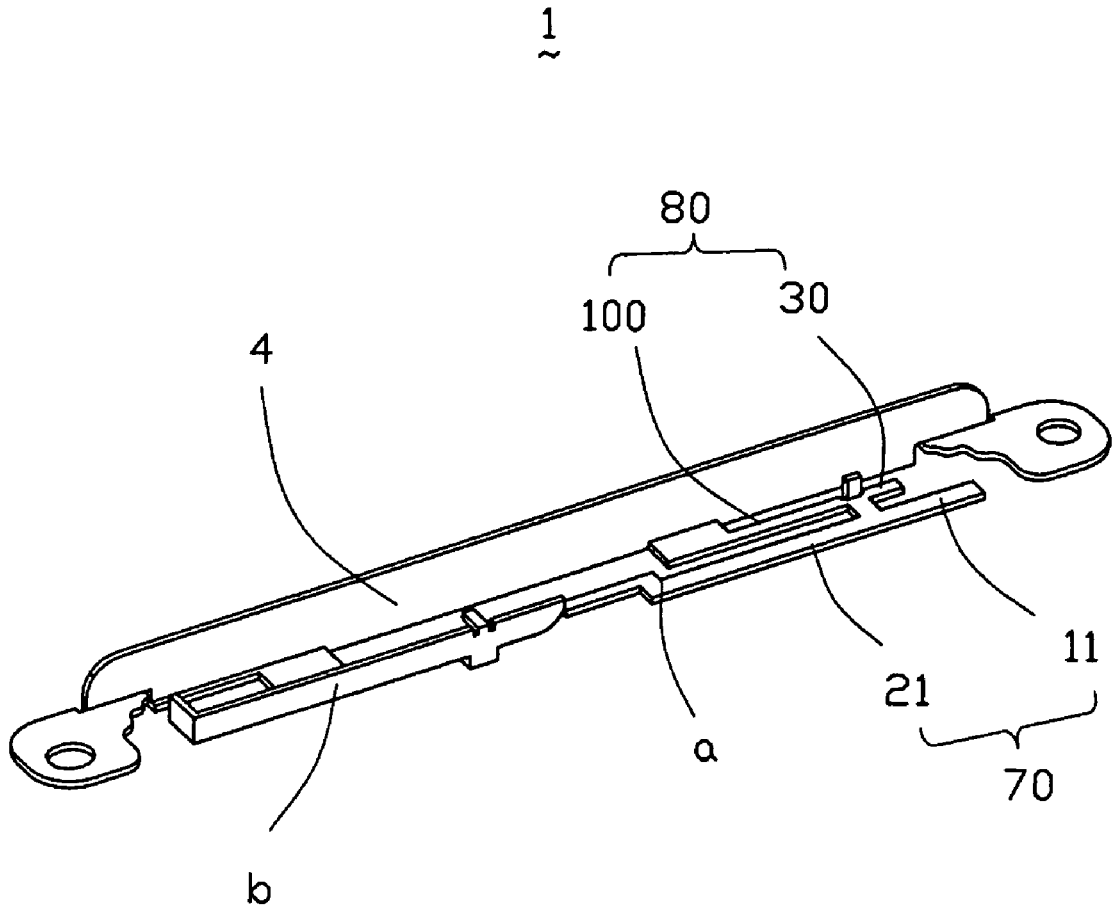
Figure 5:
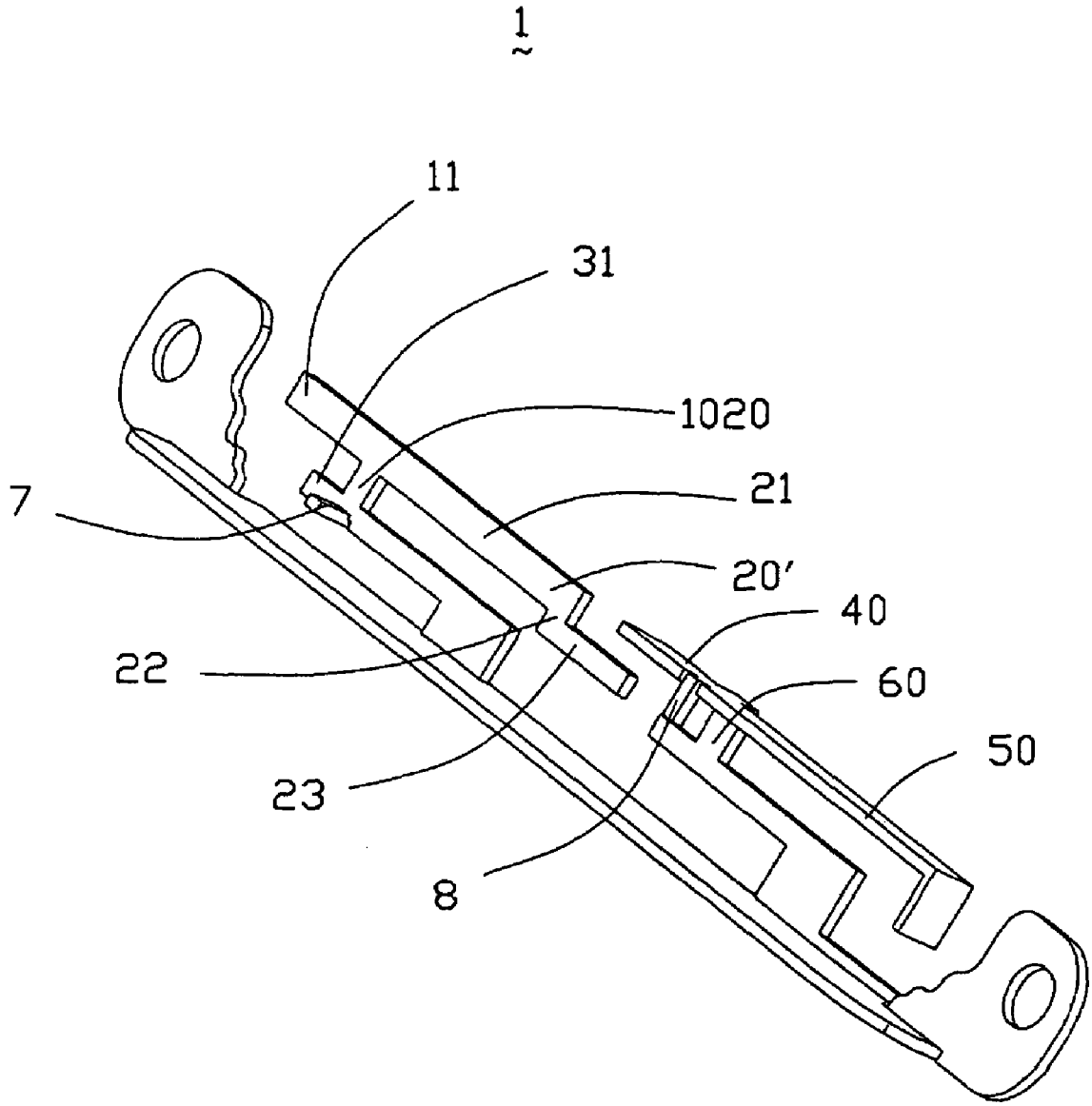

Reference to FIG. 2 to FIG. 5, a multi-band antenna 1 according to the present invention is shown. The multi-band antenna 1 is shaped from a metal patch, and comprises symmetrically arranged first antenna 2, second antenna 3, and a common grounding element 4.

The first antenna 2 comprises a first radiating element 2', a first grounding portion 200, a first connecting element 100 connecting the first radiating element 2' and the first grounding portion 200, and a feeding section 7. The first radiating element 2' comprises a first radiating section 10, a second radiating section 20, and a third radiating section 30. The first radiating section 10 and the second radiating section 20 have a common radiating arm 1020. The first radiating section 10 consists of a first radiating arm 11 and the common radiating arm 1020, and the second radiating section 20 consists of a Z-shape radiating arm 20' and the common radiating arm 1020. The Z-shape radiating arm, comprises a first arm 21 connecting with the first radiating arm 11 to form a first longwise metal arm 70, a second arm 22 extending vertically from free end of the first arm 21, and a third arm 23 extending vertically from lower end of the second arm 22. The third arm 23 is parallel to the first arm 21, and each of the first arm 21 and the third arm 23 respectively stands opposite sides of the second arm 22. The third radiating section 30 extends vertically from the common radiating arm 1020, and forms a second longwise metal arm 80 with the first connecting element 100. The radiating arm 11, the common radiating arm 1020, and the third radiating section 30 constitute a U-shape. The first grounding portion 200 extends vertically from the first connecting element 100 to connect with the grounding element 4. All of the first radiating element 2' of the first antenna 2, the first connecting element 100 and the first grounding portion 200 are located in the same plane. In this embodiment, the feeding section 7 is used to connect a feeding line (not shown), and extends vertically from the joint of the first connecting element 100 and the third radiating section 30 and is perpendicular to the plane in which the first connecting element 100 and the third radiating section 30 are located. That is, the feeding section 7 is located in a plane parallel to that of the grounding element 4. The first radiating section 10 works at a high frequency and the second radiating section 20 works at a low frequency. The third radiating section 30 is used to add the bandwidth of the first radiating section 10. In alternative embodiments of the present invention, the position of the feeding section 7 can be changed which is determined by the length change of the first radiating element 2'.

The second antenna 3 comprises a second radiating element 3', a second grounding portion 400, a second connecting element 300 connecting the second radiating element 3' and the second grounding portion 400, and a feeding section 8. The second radiating element 3' comprises a fourth radiating section 40, a fifth radiating section 50, and a sixth radiating section 60. One end of the fourth radiating section 40 connects to the sixth radiating section 60, and the other end of the fourth radiating section 40 presents arc shape. The fifth radiating section 50, an L-shape metal patch, comprises a first metal arm 51 and a second metal arm 52. The first metal arm 51 connects to the sixth radiating section 60, and the second metal arm 52 extend vertically from the first metal arm 51 toward the grounding element 4. The sixth radiating section 60 comprises a second radiating arm 61 forming a third longwise metal arm 90 together with the second connecting element 300, a third radiating arm 62 extending vertically from the second radiating arm 61, and a fourth radiating arm 63 extending from the third radiating arm 62 to connect the fourth radiating section 40 and the fifth radiating section 50. The second grounding portion 400, performing an L shape, comprises a grounding patch 401 and an extension section 402. The extension section 402 is able to enhance the intension of the structure of the second antenna 3'. The third longwise metal arm 90, the grounding patch 401 and the extension section 402 of the grounding element 40 present a Z-shape structure, and the second radiating arm 61 and the connecting element 300 respectively locate at the opposite sides of the third radiating arm 62. In this embodiments of present invention, the feeding section 8, adapted for connecting a feeding line (not shown), extends vertically to the fourth radiating arm 63 of the sixth radiating 60 from the joint of the fourth radiating section 40, the fifth radiating section 50 and the fourth radiating arm 63, and is perpendicular to the plane in which the fourth radiating section 40, the fifth radiating section 50 and the fourth radiating arm 63 are located. Thus, the free end of the feeding section 8 is parallel to the grounding element 4. The fourth radiating section 40 works at a high frequency and the fifth radiating section 50 works at a low frequency. The sixth radiating section 60 is used to add the bandwidth of the fourth radiating section 40. In alternative embodiments of the present invention, the position of the feeding section 8 can be changed determined by the length change of the radiating element 3'. The fourth radiating section 40, the fourth radiating arm 63 and the first metal arm 51 locate in a same plane perpendicular to a plane which other components of the second antenna 3 are located in.

The first radiating section 10 and the second radiating section 20 of the first antenna 2 is the main body of the first antenna 2. The fourth radiating section 40, the fifth radiating section 50, and the fourth radiating arm 63 of the sixth radiating section 60 are the main body of the second antenna 3.

The grounding element 4 has a pair of mounting portions 5, 6 respectively extending from the opposite sides thereof, and both of two mounting portions 5, 6 are located in the same plane.

All of the second grounding portion 400, the second connecting element 300, the second radiating arm 61 and the third radiating arm 62 of the sixth radiating section 60 are located in the first plane a, and all of the fourth radiating section 40, the first metal arm 51 of the fifth radiating section 50, and the fourth radiating arm 63 of the sixth radiating section 60 are in the second plane b. The first plane is perpendicular to the second plane b. In this embodiment of the present invention, the first antenna 2 is located in the second plane b, the feeding section 8 is located in the plane a, and the feeding section 7 is located in the plane b. The grounding element 4, located in the plane b, is a metal patch, and connects to the first grounding portion 200 and the second grounding portion 400.

In this embodiment of the present invention, the low-frequency radiating section 20 of the first antenna 2 is adjacent to the high-frequency radiating section 40 of the second antenna 3. The first radiating element 2' of the first antenna 2 is located in a plane different from the plane in which the fourth radiating section 40, the first metal arm 51, the fourth radiating arm 63 of the sixth radiating section 60 locate. Therefore, the influence between the first antenna 2 and the second antenna 3 is reduced in a small space.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna, comprising:

a first antenna;

a second antenna; and a common grounding element;

wherein both of said first antenna and said second antenna comprises a radiating element having a low-frequency radiating section and a high-frequency radiating section, the radiating element of said first antenna has a main body locating in a plane different from that of a main body of the radiating element of said second antenna, and said low-frequency radiating section of said first antenna is located adjacent to said high-frequency radiating section of said second antenna and far from the low-frequency radiating section of said second antenna.

2. The multi-band antenna as claimed in claim 1, wherein said plane in which said main body of said first antenna is located is perpendicular to said plane in which said main body of said second antenna is located.

3. The multi-band antenna as claimed in claim 1, wherein said first antenna comprises a first radiating section working at said high frequency, a second radiating section working at said low frequency and having a common radiating arm with said first radiating section, and a third radiating section connecting said common radiating arm and adding the bandwidth of said first radiating section.

4. The multi-band antenna as claimed in claim 3, wherein said main body of said first antenna comprises said first radiating section, said second radiating section.

5. The multi-band antenna as claimed in claim 3, wherein said second radiating section comprises an Z-shape radiating arm comprising a first arm extending from the joint of said first radiating section and said common radiating arm, a second arm extending vertically from said first arm to said grounding element, and a third arm extending vertically from said second arm and locating on the opposite sides of said second arm with said first arm.

6. The multi-band antenna as claimed in claim 5, wherein said first radiating section connects said first arm of said Z-shape radiating arm forming a longwise metal arm, and said third radiating section and said common radiating arm compose of a second longwise metal arm.

7. The multi-band antenna as claimed in claim 6, wherein said first longwise metal arm locate in a plane which is different from but parallel to the plane in which said second longwise metal arm locate.

8. The multi-band antenna as claimed in claim 5, wherein said first antenna comprises a first grounding portion connecting to said common grounding element and a first connecting portion connecting said radiating element and said first grounding portion, and said radiating element of said first antenna, said first connecting element and said first grounding portion locate in the same plane.

9. The multi-band antenna as claimed in claim 8, wherein said first antenna comprises a feeding section adapted for connecting a feeding line and extending from the joint of said third radiating section and said first connecting portion and is perpendicular to a plane in which said first connecting element and said third radiating section is located.

10. The multi-band antenna as claimed in claim 9, wherein said second antenna comprises a feeding section is located in a plane different from the plane in which said feeding section of said first antenna is located.

11. The multi-band antenna as claimed in claim 3, wherein said second antenna comprises a second grounding portion connecting said common grounding element and said second connecting portion.

12. The multi-band antenna as claimed in claim 11, wherein said radiating element of said second antenna comprises a fourth radiating section working at said high frequency, an L-shape fifth radiating section working at said low frequency, and a sixth radiating section adding the bandwidth of the high frequency.

13. The multi-band antenna as claimed in claim 12, wherein said the main body of said second antenna comprises said fourth radiating section, said fifth radiating section.

14. The multi-band antenna as claimed in claim 12, wherein said fourth radiating section of said second antenna comprises an end connecting to the sixth radiating section, and the other end presenting arc shape.

15. The multi-band antenna as claimed in claim 12, wherein said second radiating section of said first antenna is adjacent to said fourth radiating section of said second antenna.

16. The multi-band antenna as claimed in claim 1, wherein said grounding element comprises two mounting portions respectively located on the opposite sides thereof, and both of two mounting portions locate in the same plane.

17. A multi-band antenna comprising:

a first antenna;

a second antenna; and a common grounding element defined in the first plane;

the first antenna including a first radiating element having first, second and third antenna sections all extending in a second plane essentially perpendicular to the first plane, said first antenna further including a grounding section connected to the common grounding element and coplanar with the second plane;

the second antenna including a second radiating element having first, second, third antenna segments wherein the first and second antenna segments are located in a third plane parallel to the first plane and perpendicular to the second plane, while the third antenna segment is located in the second plane; and said second antenna further including a grounding segment connected to the common grounding element and coplanar with the second plane.

18. The antenna as claimed in claim 17, wherein the second radiating antenna sections defines an offset configuration while all the first radiating element is still in the same plane, while the second radiating segment forms a bent configuration defining a fourth plane so as to have the all the second radiating element is located in the second, third and fourth planes, respectively.

19. An antenna comprising:

a large grounding element defining a first plane;

a radiating element including first and second radiating segments defined in a second plane parallel to said first plane, and a third radiating segment defined in a third plane perpendicular to both said first and second planes, the second radiating segments further forming a bend extending in a fourth plane perpendicular to all first, second and third planes; wherein a feeding section is formed around a joint area of the first and second segments and extending in a fifth plane essentially parallel to the third plane, said feeding section being configured to be connected to a feeding cable.

20. The antenna as claimed in claim 19, wherein an end of the first radiating segment opposite to the second radiating segment is tipped.

* * * * *